United States Patent [19]

Fukunaga

[11] Patent Number: 4,641,493

[45] Date of Patent: Feb. 10, 1987

[54] LUBRICANT APPLICATOR FOR TWO-FOR-ONE TWISTER

[75] Inventor: Mitsuo Fukunaga, Kyoto, Japan

[73] Assignee: Murata Kikai Kabushiki Kaisha, Japan

[21] Appl. No.: 690,665

[22] Filed: Jan. 10, 1985

[30] Foreign Application Priority Data

Jan. 21, 1984 [JP] Japan ..... 59-6712[U]

[51] Int. Cl.[4] ..... D01H 13/30; D01H 7/86

[52] U.S. Cl. ..... 57/296; 57/58.83; 57/58.86; 118/211; 118/234; 118/DIG. 21

[58] Field of Search ..... 57/295–298, 57/58.49, 58.83, 58.84, 58.86; 118/76–78, 211, 234, DIG. 21

[56] References Cited

U.S. PATENT DOCUMENTS

| | | | |
|---|---|---|---|
| 2,548,856 | 4/1951 | Bauer | 118/234 |
| 2,836,146 | 5/1958 | Weber | 118/234 X |
| 3,295,305 | 1/1967 | Nimtz | 57/296 X |
| 3,295,306 | 1/1967 | Rehn | 57/58.83 |
| 3,864,901 | 2/1975 | Beymes et al. | 57/296 |
| 3,983,685 | 10/1976 | Scherf et al. | 57/296 |
| 4,380,891 | 4/1983 | Wehrmeister | 57/296 |

*Primary Examiner*—John Petrakes

*Attorney, Agent, or Firm*—Spensley Horn Jubas & Lubitz

[57] ABSTRACT

A lubricant applying device for use in a two-for-one twister, which is mounted on a tenser and is provided with a lubricant applying means on a face thereof contacting with a yarn taken out from the yarn supply package and running through the yarn guide tube. The device comprises a hollow container for reserving a liquid lubricant therein and a cap mounted on the upper portion of the container having a lubricant applying means provided on an outer face of the cap.

5 Claims, 4 Drawing Figures

LUBRICANT APPLICATOR FOR TWO-FOR-ONE TWISTER

BACKGROUND OF THE INVENTION

The present invention relates to a device to be used in a two-for-one twister for applying a lubricant to a yarn taken out from a yarn supply package.

The aforementioned lubricant is used to decrease the friction between yarns or between a yarn and another member thereby to prevent the yarn from being cut or damaged and to facilitate handling of the yarn. Especially in the two-for-one twister, the lubricant is used for preventing the yarn from being damaged when the yarn collides against a balloon limiter for regulating the size of the balloon of the yarn.

As the device for applying the aforementioned lubricant to the yarn, there have already been proposed a number of applicators which generally have the following defects. Specifically, the lubricant is applied excessively to the yarn such that lubricant consumption is high. Moreover, the consumption rates of the lubricant among the respective spindles of the two-for-one twister vary so that the lubricant has to be frequently supplied which makes its handling troublesome.

SUMMARY OF THE INVENTION

An object of the present invention is to provide a lubricant applying device for supplying the lubricant to the yarn at a remarkably small amount within a necessary range.

Another object of the present invention is to provide a lubricant applying device which facilitates adjustment of the amount of lubricant supplied to the yarn.

The present invention relates to a lubricant applying device for use in a two-for-one twister which includes a stationary disk rotatably supported on a spindle shaft and supporting a yarn supply package thereon, a tenser provided at an upper portion of the stationary disk and a hollow yarn guide tube provided at a center of the spindle shaft for guiding a yarn taken out from the yarn supply package. The lubricant applying device is mounted on the tenser and is provided with a lubricant applying means on a face thereof contacting with a yarn taken out from the yarn supply package and running through the yarn guide tube.

According to the present invention the supply of the lubricant to the yarn can be decreased to a remarkably low level within a necessary range, and the adjustment of the supply rate of the lubricant can be easily achieved. Thus, the variation of the lubricant consumption rates among the respective spindles are reduced so that handling can be facilitated.

DETAILED DESCRIPTION OF THE INVENTION

The present invention will be described below in connection with the embodiment thereof with reference to the accompanying drawings.

Figure 1:
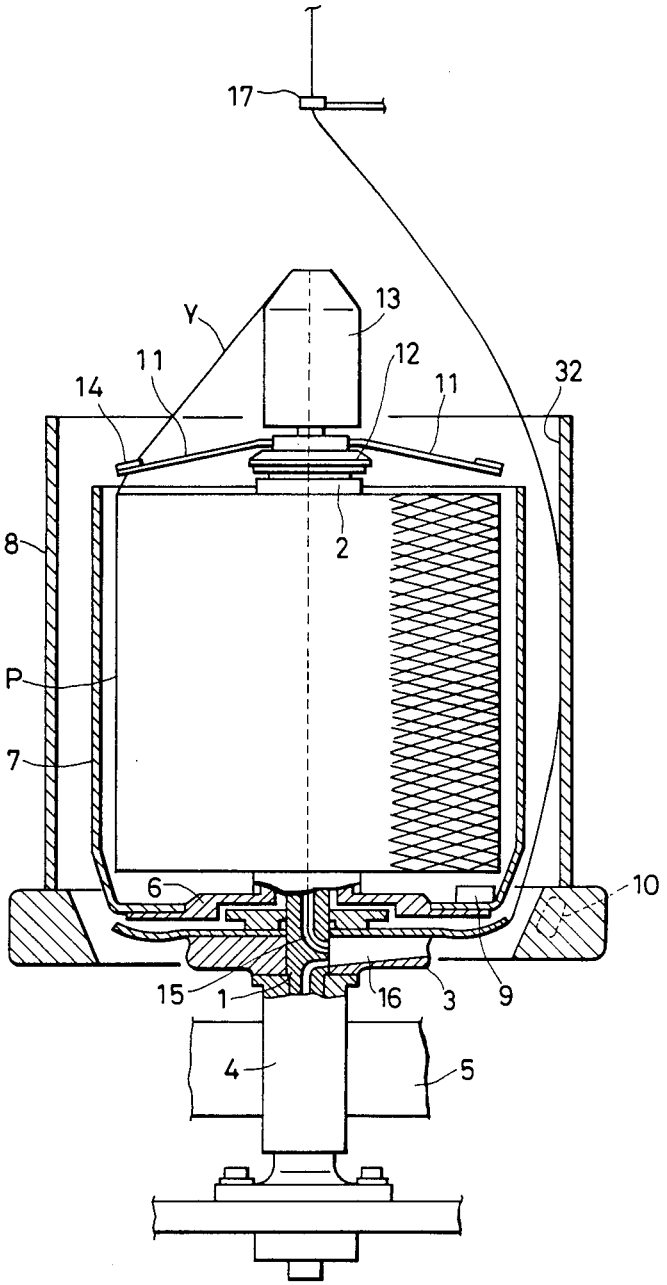
FIG. 1 is a partially longitudinally sectional front elevation of the two-for-one twister.

FIG. 1 shows one spindle of a two-for-one twister to which the present device is applied. Indicated at reference letter P is a yarn feed package which is disposed at the center of the aforementioned two-for-one twister. Indicated at numeral 1 is a spindle shaft which is positioned in a take-up tube 2 of said package P. Said shaft 1 is integrated with a yarn reserve disk 3 and a wharve 4. Indicated at numeral 5 is a drive belt which is adapted to run along the frame table for contacting and running with the aforementioned wharve 4 to rotationally drive the aforementioned spindle shaft 1 and so on at a high speed. The yarn supply package P is placed on a stationary disk 6, which is rotatably borne on the spindle shaft 1 through a not-shown bearing, and is doubly surrounded by both a yarn supply cover 7 fixed on said disk 6 and a balloon limiter 8 fixed on a not-shown machine frame, so that it is held in a stationary state even during the rotations of the spindle shaft 1 by the mutual attractions of magnets 9 and 10 mounted in the yarn supply cover 7 and the balloon limiter 8, respectively. Above the spindle shaft 1, there is placed on the aforementioned stationary disk 6 a tenser 12 which is equipped with two flyers. On said tenser 12, moreover, there is disposed a lubricant applying device 13 according to the present invention.

A yarn Y taken out from the yarn supply package P runs through a hole 14 which is formed in the leading end of one of the flyers 11. Then, the yarn Y runs downward from the upper end of the lubricant applying device 13 through a yarn passage 15 which is formed in the center of the spindle shaft 1. The yarn Y further runs to the outside through a yarn exit hole 16 which is formed to extend radially from the yarn reserve disk 3. The yarn Y contacts with and runs upward on the inner wall of the balloon limitor 8 while being swirled around the yarn supply cover 7 by the rotations of the spindle shaft 1 and the yarn reserve disk 3. After that, the yarn Y runs through a yarn guide 17 until it is taken up on a not-shown take-up package.

Figure 3:
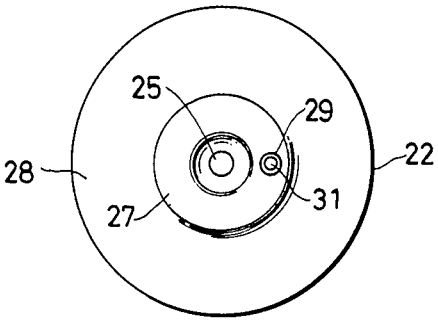
FIG. 3 is a top plan view of the same.
Figure 2:
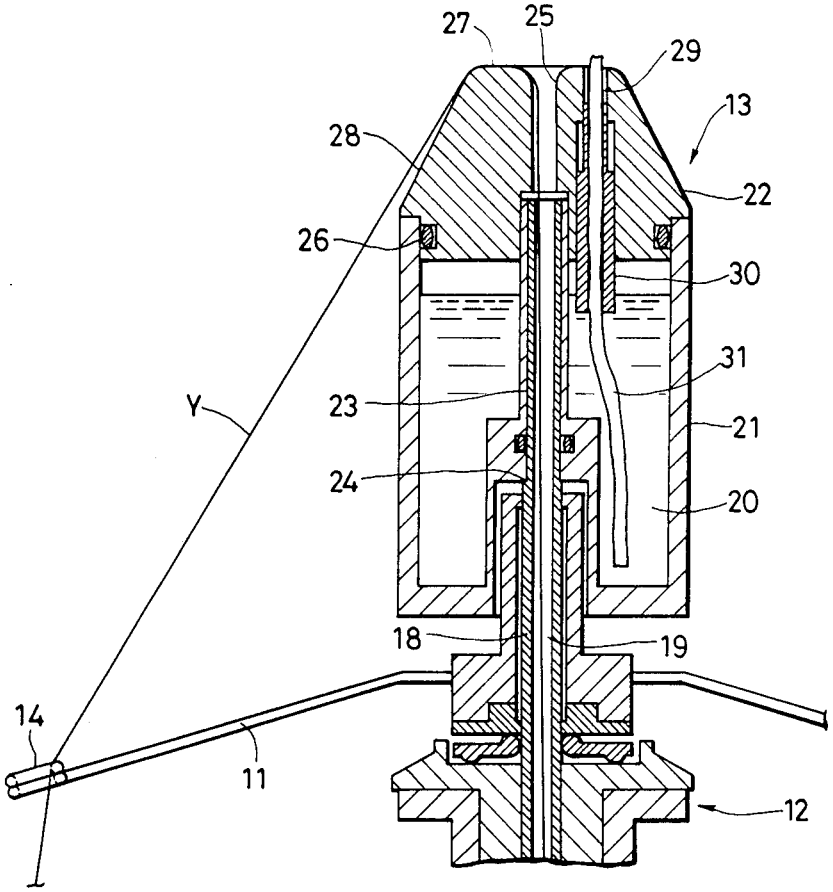
FIG. 2 is a sectional view of the lubricant apply device according to the present invention.

FIG. 2 shows a section of the lubricant applying device 13. Indicated at numeral 18 is a yarn guide tube which is fixed at the center of the tenser 12 and which is formed with a yarn through hole 19 which has communication with the yarn passage 15 of the spindle shaft 1. The aforementioned flyers 11 are adapted to freely rotate on the upper face of the tenser 12 around the aforementioned yarn guide tube 18. The lubricant applying device 13 is constructed primarily of a hollow container 21 for reserving a liquid lubricant 20 therein and a cap 22 mounted on the upper portion of said container 21. This container 21 is made of a transparent or semitransparent synthetic resin so that it can allow the lubricant 20 therein to be visually confirmed without difficulty from the outside. The container 21 is supported on a step 24 of said yarn guide tube 18 by inserting a center hole 23 formed at the center thereof into the yarn guide tube 18. The cap 22 is made of metal or ceramic and is formed at its center with a yarn entrance hole 25. Moreover, the cap 22 is removably fitted and fixed in the upper end of the container 21 by means of an O-ring 26 which is fitted in the outer circumference of the lower portion thereof. The cap 22 has its top face 27 formed into a smooth and horizontal face, around which a smooth slope 28 is formed. The yarn Y having passed through the hole 14 of the flyer 11 enters the yarn entrance hole 25, while sliding along a portion of the aforementioned slope 28 and to the top face 27, and runs through the yarn through hole 19 of the yarn guide tube 18 into the yarn passage 15 of the spindle shaft 1. The cap 22 is formed with a thin hole 29 which extends from the top face 27 to the container 21. A hollow pipe 30 is removably screwed in said thin hole 29. Into said pipe 30, moreover, there is inserted a wetting element 31 which has its upper end protruding slightly from the upper face of the cap 22 and its lower end dipped in the lubricant 20 in the container 21. The aforementioned thin hole 29 is opened substantially at one point in the top face 27 of the cap 22, as shown in FIG. 3. The wetting element 31 is made of a very thin cotton string.

The operations of the lubricant applying device 13 thus far described will be explained below. The lubricant reserved in the container 21 continuously wets the entire wetting element 31 by the capillary action. As the yarn Y is unwound from the yarn supply package P, the flyers 11 rotate so that the yarn Y swirls to sweep the top face 27 of the cap 22. Each time the yarn Y swirls once on the top face 27, it contacts with the wetting element 31 protruding from said top face 27 so that it is wetted with the lubricant 20. Because the yarn Y swirls while running, the applications of the lubricant 20 to said yarn Y are effected in a spotted form at a constant interval, as is shown exaggeratedly in FIG. 4. The yarn Y wetted with the aforementioned lubricant 20 runs from the yarn entrance hole 25 through the yarn through hole 19, the yarn passage 15 and the yarn exit hole 16 until it comes into contact with the inner wall 32 of the balloon limiter 8. In this course, the yarn Y contacts with the respective portions of its running passage so that it is uniformly wetted with the lubricant 20. In the aforementioned inner wall 32 and so on, specifically, the portions containing much lubricant 20, as indicated at numeral 33 in FIG. 4, apply a portion of said lubricant 20 to the inner wall 32 and so on, whereas the portions containing little lubricant 20, as indicated at numeral 34 receive the lubricant 20 applied to said inner wall 32 and so on. As a result, the contact between the yarn Y and the inner wall 32 is effected through the lubricant 20 at all times but does not damage the yarn Y. Moreover, a necessary amount of lubricant 20 is always supplied to the yarn Y, the inner wall 32 and so on so that its wasteful consumption is restricted. The supply of the lubricant 20 can be easily replenished by removing the cap 22 from the container 21. The length of the protrusion of the wetting element 31 from the cap top face 27 can be freely adjusted by changing the screwed depth of the pipe 30 into the cap 22. Because the aforementioned protrusion length may adjusted only at the one point on the top face 27, its most proper value can be easily set to make uniform the amount of the lubricant to be used for a unit time between the adjoining spindles of the two-for-one twister.

Figure 4:
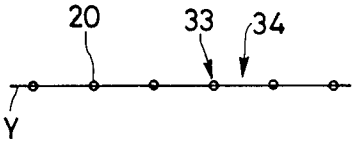
FIG. 4 is a diagram for explaining the operations of the lubricant apply device.

In the lubricant applying device 13 of the present invention, the wetting element 31 is sufficient to protrude substantially at one point on the cap top face 27. This makes it possible to effect such a lubricant application to the yarn Y, as is shown in FIG. 4. Therefore, the structure in which the wetting element protrudes from a wide area such as the whole or half area of the top face 27 is precluded from the present invention. Incidentally, the wetting element 31 may be made of not only the cotton string but also any soft string exhibiting capillary action, for example, a fibrous material or sponge or fabric.

What is claimed is:

1. A yard lubrication device in a two-for-one twister comprising:

a spindle having a substantially vertical spindle shaft capable of supporting a yarn package thereon, a tenser disposed adjacent an upper portion of said spindle shaft above the location of said yarn package a guide surface having an aperture therein mounted on said tenser, means for drawing yarn from said yarn package across said guide surface and through said aperture disposed in said guide surface, a lubrication element protruding from a portion of said guide surface, means for adjusting the degree of protrusion of said lubrication element from said guide surface, and means for intermittently bringing said yarn into contact with said lubrication element as said yarn is drawn from said yarn package through said aperture.

2. A device as in claim 1 wherein said guide surface is substantially planer.

3. A device as in claim 1 wherein said guide surface is substantially non-porous.

4. A device as in claim 1 wherein said aperture is centrally disposed within said guide surface.

5. A yarn lubrication device in a two-for-one twister comprising:

a spindle having a substantially vertical spindle shaft capable of supporting a yarn package thereon, a tenser disposed adjacent an upper portion of said spindle shaft above the location of said yarn package a guide surface having an aperture therein mounted on said tenser, means for drawing yarn from said yarn package across said guide surface and through said aperture disposed in said guide surface, a lubrication element protruding from a portion of said guide surface, and means for bringing said yarn into contact with said lubrication element at regularly spaced intervals along said yarn as said yarn is drawn from said yarn package through said aperture.

* * * * *